US005264022A

United States Patent [19]

Haygarth et al.

[11] Patent Number: 5,264,022

[45] Date of Patent: Nov. 23, 1993

[54] COMPOSITE SHOT

[75] Inventors: John C. Haygarth, Corvallis; Darryl D. Amick, Albany; Lloyd Fenwick, Corvallis, all of Oreg.

[73] Assignee: Teledyne Industries, Inc., Albany, Oreg.

[21] Appl. No.: 878,696

[22] Filed: May 5, 1992

[51] Int. Cl.[5] ..... F42B 7/04; F42B 12/74

[52] U.S. Cl. ..... 75/255; 102/448; 102/501; 420/122

[58] Field of Search ..... 420/122, 430, 431; 75/255; 102/448, 501, 514–516

[56] References Cited

U.S. PATENT DOCUMENTS

| | | | |
|---|---|---|---|
| 1,847,617 | 3/1932 | Lowenstein et al. | 420/431 |
| 3,372,021 | 3/1968 | Forbes et al. | 420/431 |
| 4,881,465 | 11/1989 | Hooper et al. | 102/501 |
| 4,949,645 | 8/1990 | Hayward et al. | 102/517 |

FOREIGN PATENT DOCUMENTS

| | | | |
|---|---|---|---|
| 52-68800 | 6/1977 | Japan | 102/514 |
| 1-142002 | 6/1989 | Japan | 420/122 |

*Primary Examiner*—George Wyszomierski

*Attorney, Agent, or Firm*—Shoemaker & Mattare, Ltd.

[57] ABSTRACT

Lead free shotshell pellets are disclosed which consist essentially of an alloy of iron and 30 to 46% by weight of tungsten. The shotshells may include a plurality of pellet sizes, and the pellets may be coated substantially uniformly with a polymeric coating, resin, or lubricant.

6 Claims, 1 Drawing Sheet

BINARY ALLOY PHASE DIAGRAMS

COMPOSITE SHOT

Field of the Invention

The present invention relates to metal shot alloys having high specific gravities and to methods for their preparation and to shot shells containing such alloy shot pellets. When compared to lead and lead alloys, these shot and shot shells are substantially non-toxic and favorably comparable in terms of their ballistic performance.

Shotshells containing lead shot pellets in current use have demonstrated highly predictable characteristics particularly when used in plastic walled shot shells with plastic shotcups. These characteristics include uniform pattern densities with a wide variety of shotgun chokes and barrel lengths, and uniform muzzle velocities with various commercially available smokeless powders. All of these characteristics contribute to lead shots efficacy on game, particularly upland game and bird hunting. This characteristic predictability has also enabled the user to confidently select appropriate shot sizes and loads for his or her own equipment for hunting or target shooting conditions. Steel shot currently does not offer the same predictability. Each hunting season is prefaced with new commercial offerings of ammunitions to ameliorate one or more of the disadvantages associated with the use of steel shot which disadvantages include lower muzzle velocities, poor pattern density and lower energy per pellet delivered to the target. Most, if not all, of these disadvantages could be overcome by the use of shot shell pellets which approximated the specific gravity of the lead or lead alloy pellets previously employed in most shot shell applications. With the increased concern for the perceived adverse environmental impact resulting from the use of lead containing pellets in shotgun shot shells there has been a need for finding a suitable substitute for the use of lead that addresses both the environmental concerns surrounding the use of lead while retaining the predictable behavior of lead in hunting and target shooting applications.

The currently approved pellet material for hunting migratory water fowl is steel. Steel shot pellets generally have a specific gravity of about 7.5 to 8.0, while lead and lead alloy pellets have a specific gravity of about 10 to 11. Further, lead is more ductile and its greater weight per unit volume permits its use with relatively fast burning smokeless powder and a variety of barrel chokes. This produces an effective predictable muzzle velocity for various barrel lengths and provides a uniform pattern at preselected test distances. These are important criteria for both target shooting such as sporting clays, trap and skeet as well as upland game and bird hunting. Conversely, steel shot pellets do not deform; they require slower burning powder, require higher density polyethylene wad material and they do not produce uniform pattern densities, particularly in the larger pellet sizes. This has necessitated the production of shot shells having two or more pellet sizes to produce better pattern densities. Unfortunately, the smaller pellet sizes, while providing better patterns, do not deliver as much energy as do the larger pellets under the same powder load conditions. The use of slower burning powder also produces a perceivable delay and together with lower muzzle velocities requires the shooter to compensate by using different leads on targets and game.

Further, the dynamics of the shot pellets are significantly affected by pellet hardness, density and shape, and it is important in finding a suitable substitute for lead pellets to consider the interaction of all those factors. However, the pattern density and shot velocity of lead shot critical for on-target accuracy and efficacy have thus far been nearly impossible to duplicate with environmentally non-toxic, safe substitutes.

It has been appreciated that high density shot pellets, i.e., shot material having a specific gravity greater than about 8gm/cm$^3$ is needed to achieve an effective range for shotshell pellets. Various methods and compositions that have been employed in fabricating non-lead shot have not yet proven completely successful for all applications. While various alternatives to lead shot have been tried, including tungsten powder imbedded in a resin matrix, drawbacks have been encountered. For example, even though tungsten metal alone has a high density, it is difficult to fabricate into shot by simple mechanical forming and its high melting point makes it impossible to fabricate into pellets using conventional shot tower techniques. The attempts to incorporate tungsten powder into a resin matrix for use as shot pellets has been attempted to overcome some of these drawbacks. The February 1992 issue of *American Hunter*, pp. 38–39 and 74 describes the shortcomings of the tungsten-resin shot pellets along with tests which describe fracturing of the pellets and a loss of both shot velocity and energy giving rise to spread out patterns. Particularly, in the smaller shot size, the tungsten-resin shot was too brittle, lacking needed elasticity and, therefore, fractured easily.

Cold compaction of other metals selected for their higher specific gravity has resulted in higher density shot pellets having an acceptable energy and muzzle velocity, such as described in U.S. Pat. No. 4,035,115, but the inventions described therein still involve the use of unwanted lead as a shot component.

Still other efforts toward substitution of lead shot have been directed to use of steel and nickel combinations and the like, particularly because their specific gravities, while considerably less than lead, is greater than the 7–8 range typical of most ferrous metals. Some of these efforts are described in U.S. Pat. Nos. 4,274,940 and 4,383,853.

Still other high density metals such as bismuth and combinations of iron, in combination tungsten and nickel have also been suggested as lead shot substitutes. However, iron has a melting point of about 1535° C; nickel about 1455° C. and tungsten higher still about 3380° C. thus creating shot fabrication difficulties. None of the suggested lead substitutes except Bismuth achieve the advantageous low melting point of lead -327° C. - requiring only minimal energy and cost-effectiveness in the manufacture of lead shot.

OBJECTS OF THE INVENTION

One object of the present invention is to find a suitable non-toxic substitute for lead shot.

Another object of this invention to use relatively high specific gravity tungsten-containing metal alloys as shot pellets for use in shot shells which are cost effective to produce and which can perform ballistically, substantially as well as lead and lead alloys.

It is yet another object of the present invention to provide non-toxic shot pellets which are suitably coated with synthetic polymeric substances to provide improved pellet dampening to thereby improve performance.

Another object of this invention is to provide processes and product made thereby for making shot shells of mixtures of steel shot and of shot made from a range of tungsten and steel alloys.

These and other objects and advantages of the present invention are achieved as more fully described hereafter.

BRIEF SUMMARY OF THE INVENTION

It has been unexpectedly found that steel/tungsten (Fe/W) based alloys, such as those containing from up to about 45% by weight and more preferably from about 30% to about 45% by weight of tungsten demonstrate not only a lower melting point than the melting point of tungsten, but also exhibit properties which make them particularly useful in preferred shot fabrication processes. The steel-tungsten alloys of the present invention, when formed into spherical particles of preselected shot diameters, are superior to currently available steel shot and can exhibit ballistic and other properties which can be comparable to conventional lead shot.

BRIEF DESCRIPTIONS OF THE DRAWINGS

FIG. 1 is a phase diagram of the Fe/W alloys used herein.

DETAILED DESCRIPTION OF THE PREFERRED EMBODIMENTS

Figure 1:
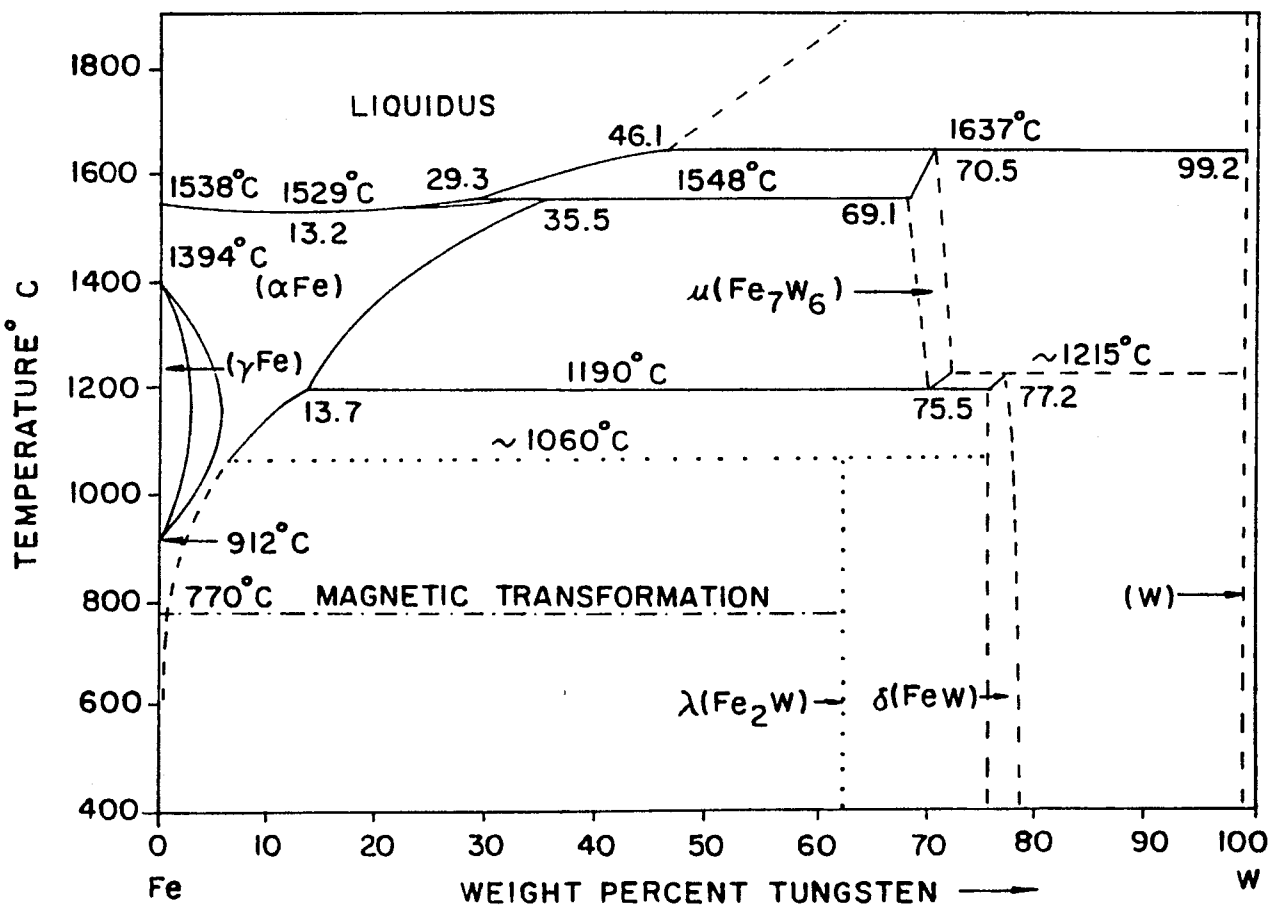

Steel-tungsten alloys, containing up to about 45% by weight of tungsten and preferably from about 30% to about by weight of tungsten can be formed into pellets suitable for use in shot shells. These pellets have specific gravities in the range of from about 8 to about 10.5. The pellets are prepared by a process consisting essentially of heating the binary alloy of steel-tungsten to a temperature above about 1548° C., then increasing to not less than about 1637° C. at which temperature the alloy evolves into a liquids phase when the tungsten is present in an amount of up to about 46.1%. The heated liquid alloy is then passed through refractory sieves having holes of a sufficient diameter, spaced appropriate distances apart to obtain the desired shot size. Unwanted high viscosity is avoided by controlling molten alloy temperature and the resulting sieved alloy is passed through a gas (air) at ambient temperature at a distance of from about 12 inches to about 30 inches, then into liquid (water) at ambient temperature causing the cooled shot to form into spheres of desired sizes. Though generally of the desired shape, they can be further smoothed and made more uniform by mechanical methods such as grinding or swaging.

EXAMPLE I

Shot or pellet types of the present invention having different sizes are obtained by first melting the Fe/W alloys.

A 200-g vacuum-arc melted button was prepared from 0.18%C steel turnings an W powder ($C_{10}$ grade). The dissolution of the W was both rapid and complete as indicated by a metallographic section. The alloy was predetermined to be 60wt %Fe/40wt %W having a calculated density of 10.303 g/cm. This compared favorably to its actual density measured at 10.46 g/cm$^3$. Conventional lead shot is 97Pb/3Sb shot and has a density of 10.84g/cm$^3$.

A larger quantity of the above alloy was melted and poured through porcelain sieves of various hole sizes and spacings, then allowed to fall through a distance of air and ambient temperature water to produce about 3.1 pounds of shot.

Molten alloy at 3000°-3100° F. was poured into a "water glass"-bonded olivine funnel containing a porcelain ceramic sieve and suspended 12" above a 6" I.D. Pyrex column containing 60" of 70° F. water. The column terminated at a Pyrex nozzle equipped with a valve through which product could be flushed into a bucket. The porcelain ceramic sieve (part number FC-166 by Hamilton Porcelains, Ltd. of Brantford, Ontario, Canada) had been modified by plugging 58% of the holes with castable refractory to obtain a pattern of holes 0.080" dia. separated by spacings of approximately 0.200". Although an oxyacetylene torch was used to preheat the funnel/sieve assembly, a melt temperature of 1685° F. resulted in very little flow through the sieve because of rapid radiative heat loss in the need for transporting molten metal from furnace-to-ladle-to-funnel in the experimental set-up employed. Increasing the melt temperature to 1745° F. resulted in rapid flow through the sieve for approximately 15 seconds, resulting in the product described in Table 1 in terms of the particle size in contrast to the shape.

TABLE 1

| Size. in. | Size Distribution Wt., lb. | Wt % |
|---|---|---|
| $-\frac{1}{2}$ | 1.90 | 62.1 |
| $+\frac{1}{4}$ | | |
| $-\frac{1}{4}$ | 0.85 | 27.8 |
| +0.157 | | |
| −0.157 | 0.30 | 9.8 |
| +0.055 | | |
| −0.055 | 0.01 | 0.3 |
| | 3.06 | 100.0 |

A sample of the −0.157"/+0.055" fraction was mounted, polished, and etched to reveal microstructural details and microporosity.

It was found that Fe/W alloy is particularly effective in forming relatively round, homogeneous diameter particles of ≦0.25" which become spherical in a free fall through about 12" of air, then through about 60" of water at ambient temperature (70° F).

It is believed that the pellet diameter is not strictly a function of the sieve hole diameter because droplets of spherical shape grow in diameter until a "drip-off" size is achieved. In addition, if the viscosity of the melted alloy is too low, multiple streams of metal will flow together forming a liquid ligament.

This desired viscosity can be controlled by adjusting the temperature of the molten alloy to achieve the desired shot formation. That is, avoiding merging streams and tear drop shapes. This can be accomplished without undue experimentation with the specific equipment or apparatus sued by maintaining its temperature high enough so that at the point where the liquid metal enters the sieve its surface tension will cause the formation of spherical droplets from the sieve.

By controlling the alloy melt and the sieving temperature, so-called ligaments or elongated shot are avoided as well as other anomalous sizes and shapes caused by unwanted high viscosity.

The present invention overcomes many of the disadvantages of steel shot previously described, including less than desirable pattern density. Even though various pellet sizes can be used for steel shot shells, because the specific gravity of Fe is 7–8.6, its ballistic performance results for any given size is charaterized by decreased force or energy, compared to lead and lead alloys.

In overcoming this, the present invention includes cartridges of multiple shot sizes such as the so-called duplex or triplex combinations of different pellet sizes presently commerically available, which are said to increase the pattern density of the pellets delivered to a test target. By preselecting a particular distribution of shot sizes, i.e., diameters, and the proportion of the different sizes of pellets within the cartridge, an appropriate or desired pattern density can be achieved with a high degree of accuracy and effectiveness.

In addition, the pellet charge of the present invention consist of various sized shot and include mixtures of both high and low specific gravity alloy pellets of different diameters.

Heretofore, lead shot provided the standard against which accuracy and field saturation was measured generally using only one size pellet. Lead-free shot pellets made of the Fe/W alloys of the present invention possess advantages both over toxic lead pellets and other metals substituted as replacements. This is particularly so because the different specific gravities in the mixture of shot pellets sizes, easily produced by the processes disclosed herein, provide a superior pattern density and relatively uniform delivered energy per pellet.

By providing a predetermined pellet mix of two (duplex) or three (triplex) or more pellet combinations of varying diameters and varying densities or specific gravities, both the pattern density over the distance between discharge and on the target and the depth of impact of the smaller shot is improved. The energy of the shot combination is improved because there is little shot deviation of firing. The increased drag forces (per unit volume) encountered by a relatively smaller particle at a given velocity in air may be offset by constructing such a particle from alloy of a relatively higher specific gravity. The larger diameter steel shot on the other hand with a larger diameter and less specific gravity is correlated as described hereinafter to the smaller size Fe/W shot.

Appropriate selection of shot sizes and the specific gravity of the alloys used for the various shot sizes can provide for the same energy delivered by each size to a preselected target. This can most graphically be demonstrated by the gelatin block test, etc. This will provide a significant improvement over the present use of steel pellets of the same specific gravity and different diameters used in the so-called "duplex" and "triplex" products. Because their diameters differ, shot pellets of the same specific gravity will exhibit different ballistic patterns.

By determining the drag force of spheres, such as round shot pellets, traveling through a fluid, such as air, the drag forces of different metals having different radii and specific gravities can be determined.

$$\text{Drag Force} = (\pi R^2)\frac{(\rho V^2)f}{2}$$

where R=radius, p=density or specific gravity, V=velocity and f=friction factor (a function of several variables including Reynolds number, roughness, etc.

The drag forces per unit volume for both steel shot and FeW shot are determined and equated according to the following:

$$\frac{R_1}{R_2} = \frac{\rho 2}{\rho 1}$$

where $R_1$, $p^1$ refer to steel and $R^2$, $p^2$ refer to FeW alloy, then $R^1 = (\mathbf{10.5})_{(8.0)}$, $R^2 = \mathbf{1.31}$, as an example. By this method, the following mixes (duplex) of two pellet sizes and compositions are obtained, and presented as examples.

| Mixture | Steel Size | GOFE 40W size |
|---|---|---|
| #1 | #6 (0.11" dia) | #9 (0.08" dia) |
| #2 | #5 (0.12" dia) | #7½(0.095" dia) |
| #3 | #2 (0.15" dia) | #6 (0.11" dia) |
| #4 | BB (0.18" dia) | #4 (0.13" dia.) |

It is contemplated that various other specific methods of melting various material configurations of iron and tungsten together or separately and then mixed, can successfully be employed in the practice of the present invention.

Further, improvements in the ballistic performance rust prevention and abrasiveness to steel barrels can be achieved by coating the pellets of the present invention with a suitable layer of lubricant or polymeric or resinous material. The mixed shotshell pellets where steel alone is the material of choice for one or more of the pellet sizes may also advantageously be coated as described herein to improve resistance to oxidation. The covering or coating can be of any suitable synthetic plastic or resinous material that will form an oxidation resistant or lubricant film which adheres to the pellets. Preferably, the coating should provide a non-sticking surface to other similarly coated pellets, and be capable of providing resistance to abrasion of the pellet against the steel barrel. Typically suitable materials can be selected from petroleum based lubricants, synthetic lubricants, nylon, teflon, polyvinyl compounds, polyethylene polypropylene, and derivatives and blends thereof as well as any of a wide variety of elastomeric polymers including ABS polymers, natural and synthetic resins and the like. Coatings may be applied by methods suitable to the materials selected which could include hot melt application, emulsion polymerization, solvent evaporation or any other suitable technique that provides a substantially uniform coating that adheres well and exhibits the previously described characteristics.

In addition, the shot shells of the present invention can employ buffering materials to fit either interstitially with the shot charge or not. depending on the performance parameters sought. Granules of polyolefins or polystyrene or polyurethane or other expanded or solid materials can be utilized and some have been employed in conventional lead and lead alloy and steel shot charges in shot shells. Such buffering with or without shot coatings may advantageously be employed to add dampening and shot and barrel lubrication properties, The shot shells of the present invention can be fabricated with or without conventional shotcup wads.

The inventions described herein are capable of being practiced over a wide variety of conditions, alloy compositions, shot pellet sizes, and with or without a wide variety of coating compositions.

The scope of the invention is not intended to be limited to the description alone but rather defined by the scope of the appended claims as limited by the applicable prior art.

We claim:

1. High specific gravity non-toxic, lead free shotshell pellets consisting essentially of an alloy of iron and from about 30% to 46% by weight tungsten.

2. The shot pellets of claim 1 in which the specific gravity is from about 8 to about 10.5.

3. High specific gravity, non toxic shot lead free pellets of claim 1 substantially uniformly coated with a natural or synthetic resin, or lubricant, or a synthetic polymer or elastomer.

4. A lead-free shot shell containing pellets in a plurality of shot pellet sizes and further comprising at least one shot size consisting essentially of an alloy of iron and tungsten containing from about 30% to about 46% by weight of tungsten and at least one shot size consisting essentially of steel.

5. The shotshells of claim 4 wherein at least some of the pellets are covered substantially uniformly with a polymeric coating.

6. The shotshells of claim 4 wherein granular buffering materials are included with the shot pellets.

* * * * *